United States Patent [19]

Mullican

[11] Patent Number: 4,786,051

[45] Date of Patent: Nov. 22, 1988

[54] EXERCISING APPARATUS

[76] Inventor: Joe E. Mullican, P.O. Box 1977, Elk City, Okla. 73648

[21] Appl. No.: 924,997

[22] Filed: Oct. 30, 1986

[51] Int. Cl.[4] ..... A63B 21/00

[52] U.S. Cl. ..... 272/134; 272/144; 188/319

[58] Field of Search ..... 272/130, 134, 144, 125; 188/319

[56] References Cited

U.S. PATENT DOCUMENTS

| | | | |
|---|---|---|---|
| D. 226,439 | 3/1973 | Coker | D34/5 K |
| 3,359,802 | 12/1967 | Sollenberger | 73/379 |
| 3,369,403 | 2/1968 | Carlin et al. | 73/379 |
| 3,387,843 | 6/1968 | Chandler | 272/79 |
| 3,822,599 | 7/1974 | Brentham | 73/379 |
| 3,984,102 | 10/1976 | Evans | 272/130 |
| 4,241,913 | 12/1980 | Zwayer et al. | 272/130 |
| 4,290,509 | 9/1981 | Berger | 272/130 |
| 4,291,787 | 9/1981 | Brentham | 188/318 |
| 4,353,547 | 10/1982 | Jenkinson | 272/130 |
| 4,358,108 | 11/1982 | Voris | 272/134 X |
| 4,390,179 | 6/1983 | Szkalak | 272/134 X |
| 4,480,832 | 11/1984 | Bulmash et al. | 272/130 |
| 4,511,137 | 4/1985 | Jones | 272/134 X |
| 4,576,377 | 3/1986 | Wolff | 272/134 X |
| 4,620,701 | 11/1986 | Mojden | 272/144 |
| 4,627,610 | 12/1986 | Ishida et al. | 272/130 X |
| 4,635,934 | 1/1987 | Roethke | 272/144 |
| 4,645,205 | 2/1987 | Wolff | 272/130 X |

FOREIGN PATENT DOCUMENTS 0196030 10/1986 European Pat. Off. ..... 188/319

*Primary Examiner*—Carl D. Friedman

*Attorney, Agent, or Firm*—Clifford C. Dougherty, III

[57] ABSTRACT

An exercising apparatus that utilizes a hydraulic ram to provide resistance to force applied by the operator of the apparatus is provided. The apparatus includes a frame and an exercise bar. The exercise bar has a first end and a second end, and is pivotally attached between its first and second ends to the frame. A first exercising means is attached to the first end of the exercise bar, and a second exercising means is attached to the second end of the exercise bar. The exercising means allow the user of the apparatus to move the exercise bar relative to the frame. First and second user support means for supporting the user while the user operates the first and second exercising means to move the exercise bar are positioned adjacent the first and second exercising means, respectively, forming a first exercise station and a second exercise station. The hydraulic ram is disposed between the exercise bar and the frame and provides resistance to the movement of the exercise bar relative to the frame in one direction, but substantially no resistance to the movement of the exercise bar relative to the frame in the other direction. The resistance to the movement of the exercise bar in the one direction is adjustable whereby the force required to be exerted on the exercise bar by way of the first and second exercising means to overcome the resistance can be selectively changed.

28 Claims, 4 Drawing Sheets

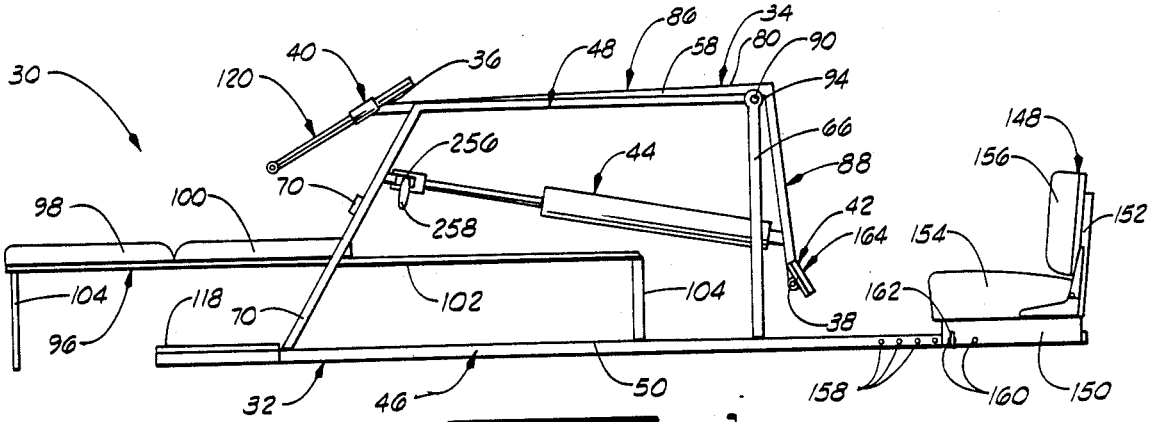
FIG. 1
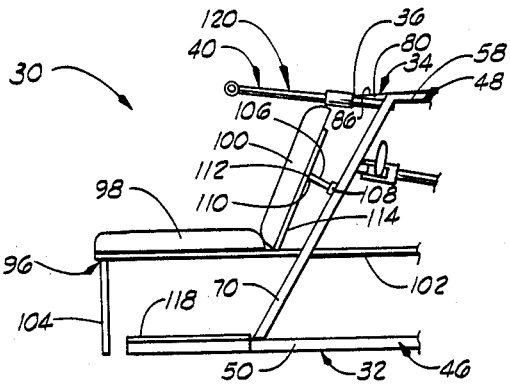
FIG. 2
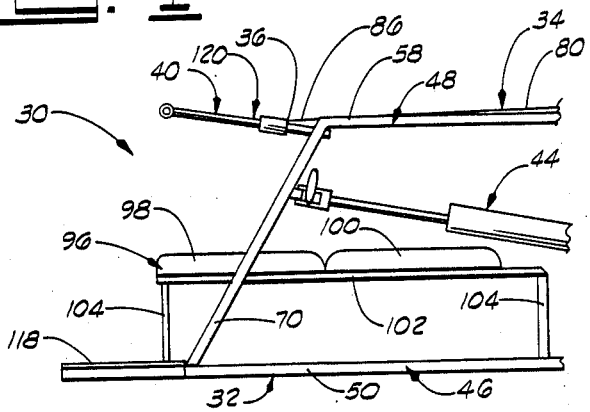
FIG. 3
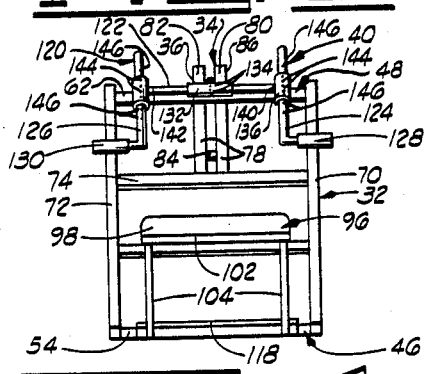
FIG. 4
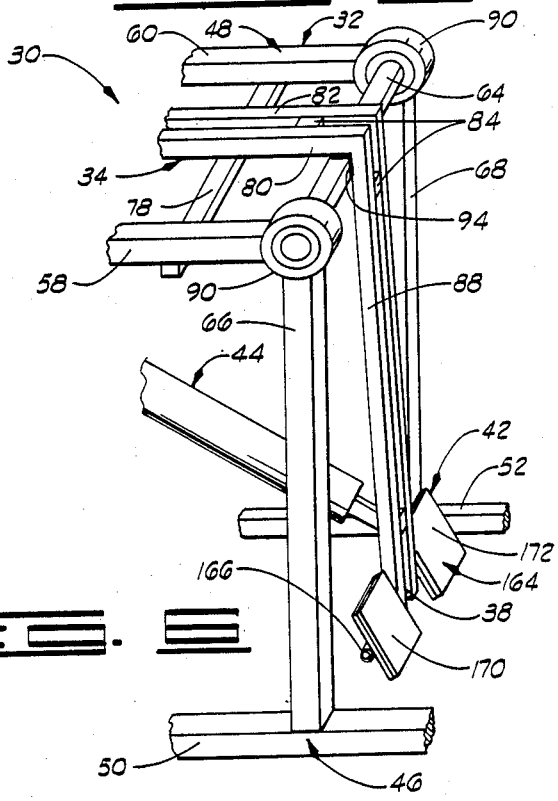
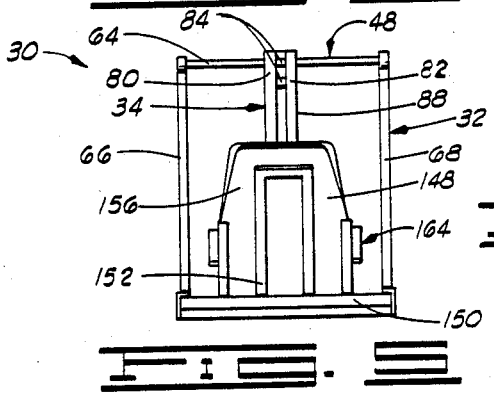
FIG. 5

EXERCISING APPARATUS

BACKGROUND OF THE INVENTION

1. Field of the Invention

This invention relates generally to exercising equipment, and more particularly, but not by way of limitation, to exercising machines that utilize hydraulic systems to provide resistance to operator applied exercising force.

2. Description of the Prior Art

Today, good health is highly emphasized in our society. Proper maintenance of the cardiovascular system and various muscle groups requires a great deal of exercise. Weight lifting is a popular type of exercise that provides a very effective means to achieve and maintain good health.

The traditional method of weight lifting is "free" weight lifting. Free weight lifting is generally performed with barbells and dumbbells. Due to the danger and complexity involved, free weight exercises have been replaced to a large extent with exercises performed on exercise machines. Exercise machines provide more efficient ways to exercise and are much easier and safer to use.

An exercise machine operates by providing resistance to various exercising forces exerted or applied by the exerciser or machine operator. Most conventional exercise machines utilize adjustable weight stacks to provide the resistance.

Although machine weight lifting has many advantages over free weight lifting, conventional weight machines are not suitable in all applications. Most conventional machines are too expensive for the individual weight lifter to afford. It is often very burdensome, time consuming and dangerous for the operator to adjust the weights. The conventional weight machines are generally too heavy to be moved, and take up a great deal of space. The constant sound of clashing weights makes the machines too noisy for many environments.

In addition, conventional weight machines are not suitable for certain types of exercises. The weights provide both positive and negative resistance. Positive resistance is created when the weights are lifted or pushed. Negative resistance is created when the weights are lowered or released. For some types of exercises, particularly "rapid thrust" type exercises, the sudden transfer of supporting energy from one set of muscles to another created by a sudden change in resistance can cause muscular strains and other injuries.

To lessen some of the problems associated with conventional machines, various exercise machines have heretofore been developed which utilize hydraulic systems instead of weights to provide resistance to the various exercising forces applied by the machine operators. The resistance is created by restricting the flow of hydraulic fluid from one side of a piston to another. Some of the machines previously developed provide adjustable resistance to the exercising forces applied in one direction, but little or no resistance to forces applied in the opposite direction. This allows "rapid thrust" type exercises to be performed. See U.S. Pat. Nos. 4,241,913 and 4,480,832. The resistance to force applied in the one direction is created by passing the fluid through a restricted opening. When force is applied in the opposite direction, the fluid is allowed to freely flow around the restricted opening. By bypassing the fluid, the resistance is minimized or eliminated.

Many of the hydraulic exercise machines heretofore developed include complex conduit systems that are easily broken and hard to maintain. The resistance provided is often difficult or impossible to adjust. Only limited types of exercises can be performed on many machines.

Thus, there is a need for a simple hydraulic exercise machine that provides resistance to force applied in one direction, but little or no resistance to force applied in the opposite direction. There is a need for such a machine that allows a wide variety of exercises to be performed without taking up a great deal of space, and which is easy to adjust and safe to use.

SUMMARY OF THE INVENTION

By the present invention, an exercising apparatus that utilizes a hydraulic ram to provide resistance to force applied by the operator is provided. The apparatus includes a frame, an exercise bar pivotally attached to the frame, exercise means attached to the exercise bar for allowing the user of the apparatus to move the exercise bar relative to the frame, and a hydraulic ram disposed between the exercise bar and the frame for providing resistance to movement of the exercise bar relative to the frame in one direction, but providing substantially no resistance to movement of the exercise bar relative to the frame in the other direction.

In one embodiment, the exercise bar has a first end and a second end, and is pivotally attached between the first and second ends to the frame. The exercising apparatus includes first and second exercise stations. The first exercise station includes first exercising means attached to the first end of the exercise bar for allowing the user of the apparatus to move the exercise bar relative to the frame and first user support means positioned adjacent the first exercising means for supporting the user while the user operates the first exercising means to move the exercise bar. The second exercise station includes second exercising means attached to the second end of the exercise bar for allowing the user to move the exercise bar relative to the frame and second user support means positioned adjacent the second exercising means for supporting the user while the user operates the second exercising means to move the exercise bar.

The hydraulic ram includes a ram housing for containing hydraulic fluid and a ram plunger slidably disposed within the housing. The ram housing has a first end and a second end. The opposite sides of the ram plunger form first and second hydraulic fluid chambers within the housing adjacent the first and second ends, respectively, of the housing. The plunger includes at least one hydraulic fluid flow passage therein communicating the first and second chambers.

Check valve means are attached to the plunger for allowing hydraulic fluid to freely flow through the passage in the plunger from the first chamber to the second chamber, but preventing fluid from flowing from the second chamber to the first chamber.

A hollow ram shaft sealingly extends through an opening in the first end of the housing. The shaft has first and second ends, one of the second end of the housing and the second end of the shaft being attached to the frame. The other of the second end of the housing and the second end of the shaft is attached to the exercise bar. The first end of the shaft is attached to the plunger and extends therethrough. Movement of the exercise bar causes relative movement between the ram housing and the ram plunger.

The hollow ram shaft has an enlarger internal portion adjacent the first end thereof. The enlarged internal portion includes a first hydraulic fluid port extending from the interior to the exterior thereof and positioned adjacent the plunger on the side thereof forming the first chamber. Hydraulic fluid can flow from the second chamber to the first chamber by way of the first end of the hollow ram shaft, the enlarged internal portion of the shaft and the first port disposed therein.

The hydraulic ram further includes an adjustable valve for controlling the rate of flow of hydraulic fluid from the second chamber to the first chamber by way of the first end of the hollow ram shaft, the enlarged internal portion of the shaft and the first port therein, and thereby controlling the resistance to movement of the exercise bar relative to the frame in the one direction.

The adjustable valve includes a cylinder sealingly and rotatably disposed within the enlarged internal portion of the hollow ram shaft adjacent the first port thereof. The end of the cylinder facing the second end of the shaft is closed. The cylinder includes a second hydraulic fluid port disposed through a side thereof and positioned whereby the first port of the enlarged internal portion of the ram shaft and the second port of the cylinder can be moved into and out of alignment with each other by rotating the cylinder. Moving the ports into and out of alignment with each other increases or decreases the rate of flow of hydraulic fluid from the second chamber to the first chamber.

The adjustable valve also includes means for manually rotating the cylinder from outside the ram housing to move the first port of the enlarged internal portion of the ram shaft and the second port of the cylinder into and out of alignment with each other.

It is, therefore, an important object of the present invention to provide an exercising apparatus that utilizes a hydraulic system to provide resistance to various exercising forces applied by the operator.

It is another object of the present invention to provide such an apparatus that provides adjustable resistance to force applied in one direction, but little or no resistance to force applied in the opposite direction.

Another object of the present invention is to provide such an apparatus wherein the resistance to force may be accurately varied quickly and with minimum effort.

Another object of the present invention is to provide an exercising apparatus that is light weight and simple, yet one that includes two exercising stations and allows for a wide variety of exercises to be performed without time consuming modification of the structure.

Further objects of the present invention are to provide an exercising apparatus that is safe, quiet and inexpensive, and that takes up little space during both use and storage.

Numerous other objects, features and advantages of the present invention will be readily apparent to those skilled in the art upon a reading of the following detailed description of a preferred embodiment of the invention when taken in conjunction with the accompanying drawings.

BRIEF DESCRIPTION OF THE DRAWINGS

FIG. 1 is a side elevational view of the apparatus of the present invention.

FIG. 2 is a partial side elevational view of the apparatus showing the bench thereof as transformed into a seat.

FIG. 3 is a partial side elevational view of the apparatus showing the bench moved in toward the frame.

FIG. 4 is an end elevational view of the apparatus showing the bench and bench press member thereof.

FIG. 5 is an end elevational view of the apparatus showing the seat and leg press member thereof.

FIG. 6 is a partial isometric view of the apparatus showing the leg press member thereof.

FIG. 18 is a top view of the ram plunger of the apparatus.

FIG. 19 is a bottom view of the ram plunger of the apparatus.

DETAILED DESCRIPTION OF THE PREFERRED EMBODIMENTS

Figure 7:
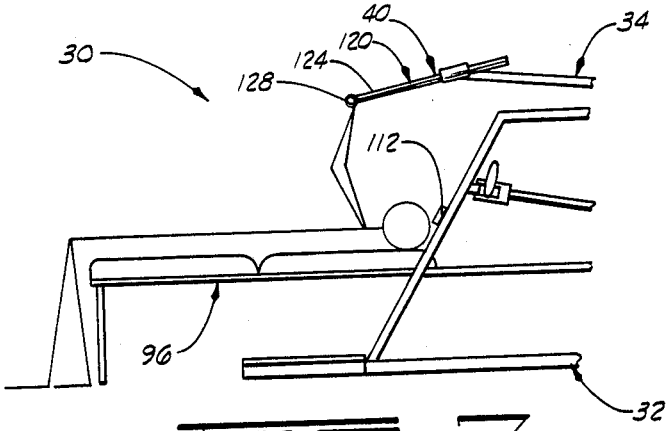
FIGS. 7–11 are partial side elevational views schematically illustrating various exercises that may be performed using the bench and bench press member of the apparatus.

Referring now to the drawings, and particularly to FIGS. 1–6, a preferred embodiment of the apparatus of the present invention is illustrated and generally designated by the numeral 30. The apparatus 30 includes a frame 32 and an exercise bar 34. The exercise bar 34 has a first end 36 and a second end 38, and is pivotally attached between the first and second ends to the frame 32. The apparatus 30 a first exercise station 35 and a second exercise station 37. The first exercise station 35 includes includes first exercising means 40 attached to the first end 36 of the exercise bar 34 for allowing the user or operator of the apparatus 30 to move the exercise bar relative to the frame 32 and first user support means 39 positioned adjacent the first exercising means for supporting the user while the user operates the first exercising means to move the exercise bar. The second exercising station 37 includes second exercising means 42 attached to the second end 38 of the exercise bar 34 for allowing the user or operator of the apparatus 30 to move the exercise bar relative to the frame 32 and second user support means 41 positioned adjacent the second exercising means for supporting the user while the user operates the second exercising means to move the exercise bar. As used herein, the terms "user" and "operator" are synonymous, and refer to the person using the apparatus to exercise. As will be described further below, the user or operator exercises by moving the exercise bar 34 relative to the frame 32.

A hydraulic ram 44 is disposed between the exercise bar 34 and the frame 32 for providing resistance to movement of the exercise bar relative to the frame in one direction, but providing substantially no resistance to movement of the exercise bar relative to the frame in the other direction. The hydraulic ram 44 includes means for adjusting the resistance to movement of the exercise bar 34 whereby the force required to be exerted on the bar by way of the first and second exercising means 40 and 42 to overcome the resistance can be selectively changed.

The frame 32 of the apparatus 30 includes a frame base 46 and a frame top 48. The frame base 46 includes a first base side member 50 and a second base side member 52. The first and second base side members 50 and 52 are connected together by a first base end member 54. The frame top 48 is rectangular in shape and includes a first top side member 58 and a second top side member 60. The first and second top side members 58 and 60 are connected together by a first top end member 62 and a second top end member 64.

The frame base 46 and the frame top 48 are connected together by a first vertical frame member 66, a second vertical frame member 68, a first inclined frame member 70 and a second inclined frame member 72. A first horizontal support bar 74 is disposed between the first and second inclined frame members 70 and 72. A pair of parallel vertical support bars 76 extend from the first horizontal support bar 74 to the first top end member 62. A second horizontal support bar (not shown) is disposed between the first and second base side members 50 and 52. A third horizontal support bar 78 is disposed between the first and second top side members 58 and 60. Other support bars can be disposed in various positions to add more support to the frame 32.

As best shown in FIG. 6, a pair of rails 80 and 82 are connected together by a plurality of rail support members 84 to form the exercise bar 34. The exercise bar 34 includes a first arm 86 and a second arm 88. The second arm 88 angularly extends downwardly from the first arm 86 toward the frame base 46. A pair of corner fittings 90 are attached to the first and second top side members 58 and 60 and receive the ends of the second top end member 64 to rotatably hold the second top end member 64 between the first and second top side members and to connect the top side members together. The first and second arms 86 and 88 of the exercise bar 34 are joined together at a fulcrum point 94. The exercise bar 34 is attached to the second top end member 64 at the fulcrum point 94.

The first user support means 39 includes a bench 96. The bench 96 includes a first portion 98, a second portion 100, a foundation 102 and a plurality of legs 104. As shown in FIG. 2, the second portion 100 is inclinable upwardly relative to the first portion 98 in order to transform the bench 96 into a seat. A brace 106 maintains the second portion 100 of the bench 96 in the upright position. A first end 108 of the brace 106 is pivotally connected to the first horizontal support bar 74 of the frame 32. A second end 110 of the brace 106 is positioned in a slot 112 formed in a back portion 114 of the second portion 100 of the bench 96. The brace 106 pivots downwardly in a position out of the way of the user or operator when not used to maintain the second portion 100 of the bench 96 in an upright position.

As shown in FIG. 1, a headrest 116 is attached to the parallel vertical support bars 76 in order to protect the head of the user while the user is lying on the bench 96. Other safety pads can be placed on the apparatus 30 in appropriate places.

The bench 96 is slidably attached to and may be moved toward or away from the frame 32. The bench 96 is shown in a position moved away from the frame 32 in FIG. 1. The bench 96 is shown in a position moved toward the frame 32 in FIG. 3. The bench 96 may be positioned at any distance from the frame 32 depending upon the position desired by the user. When the bench 96 is moved in toward the frame 32, a ground pad 118 is exposed. The ground pad 118 is attached to the first base end member 54. It may be used as a pad for the user to stand on while using the first exercise means 40 to perform various exercises. The bench 96 can be moved in toward the frame 32 during storage to conserve space.

The first exercising means 40 includes a bench press member 120 for supporting the hands of the user. The bench press member 120 includes a handle bar 122 rotatably attached to the first end 36 of the exercise bar 34, first and second hand grip arms 124 and 126, each slidably and rotatably attached to the handle bar, and first and second hand grips 128 and 130, attached to the first and second hand grip arms, respectively. Each hand grip 128 and 130 extends perpendicularly from the corresponding hand grip arm 124 and 126.

As shown in FIG. 4, the position of the bench press member 120 is adjustable in various ways to accommodate the user and to allow a wide variety of exercises to be performed therewith. The handle bar 122 may be rotated relative to the exercise bar 34 to move the first and second hand grip arms, 124 and 126, and the first and second hand grips, 128 and 130, up or down relative to the frame 32. The handle bar 122 is received by a handle bar receiving member 132 which is, in turn, attached to the first end 36 of the exercise bar 34. With the hand grip arms and the hand grips adjusted up or down relative to the frame, one or more of a plurality of holes 134 disposed in the handle bar receiving member 132 are aligned with one or more of a plurality of holes (not shown) disposed in the handle bar 122, and a bolt or pin (not shown) in inserted through the aligned holes to lock the hand grip arms and hand grips in the desired position.

Each of the first and second hand grip arms 124 and 126 may be moved perpendicularly relative to the handle bar 122 to move the corresponding hand grips 128 and 130 toward or away from the handle bar. The first and second hand grip arms 124 and 126 are received by first and second hand grip arm receiving members 136 and 138, respectively. The first and second hand grip arm receiving members 136 and 138 are attached to opposite ends 140 and 142 of the handle bar 122. With the hand grips moved toward or away from the handle bar, one or more of a plurality of holes 144 in each hand grip arm receiving member are aligned with one or more of a plurality of holes 146 in each hand grip arm, and bolts or pins (not shown) are inserted through the aligned holes to lock the hand grips in the desired position.

Finally, the first and second hand grip arms 124 and 126 may be rotated relative to the handle bar 122 to move the corresponding first and second hand grips 128 and 130 toward or away from each other. With each hand grip moved toward or away from each other, one or more of the holes 144 in each hand grip arm receiving member are aligned with one or more of the holes 146 in each hand grip arm, and bolts or pins (not shown) are inserted through the aligned holes to lock the hand grips in the desired position. The same bolts or pins that are used to lock the first and second hand grips 128 and 130 in the desired position toward or away from the handle bar 122 may be used to lock the hand grips 128 and 130 in the desired position toward or away from each other. The various positions of the bench press member 120 are further described below.

The second user support means 41 includes a seat 148. The seat 148 is slidably attached to and may be moved toward or away from the frame 32. As shown in FIGS. 1 and 5, the seat includes a frame 150, a seat back support bar 152, a base portion 154 and a back portion 156. With the seat 148 moved in the desired position toward or away from the frame 32, one or more of a plurality of holes 158 disposed in each base side member 50 and 52 are aligned with one or more of a plurality of corresponding holes 160 disposed in the frame 150 of the seat 148. Bolts or pins 162 are inserted through the aligned holes to lock the seat in the desired position.

The second exercising means 42 includes a leg press member 164 for supporting the feet of the user. As shown best in Figure 6, the leg press member 164 includes a first foot pad arm 166 and a second foot pad arm (not shown) attached to and extending in opposite directions from the second end 38 of the exercise bar 34. First and second foot pads 170 and 172 are rotatably attached to the first and second foot pad arms 166 and 168, respectively. Each foot pad 170 and 172 can be rotated relative to the exercise bar 34 and the foot pad arms to accommodate the feet of the user and to allow a variety of exercises to be performed therewith.

OPERATION OF THE EXERCISING APPARATUS IN GENERAL

Referring now to FIGS. 7–14, the operation of the apparatus 30 and the various types of exercises that may be performed thereon will be described.

A standard bench press exercise is illustrated in FIG. 7. The bench 96 is moved to the desired position, either toward or away from the frame 32. The first and second hand grip arms, 124 and 126, and corresponding hand grips, 128 and 130, are adjusted up or down relative to the frame 32 and either toward or away from the handle bar 122 depending upon the positions desired by the user. The hand grips 128 and 130 are then moved away from each other to extend in opposite directions. After the adjustments are made, the user lies on the bench, on his (or her) back, with his (or her) head towards the apparatus 30. The user then grasps the first and second hand grips with his (or her) hands and pushes the bench press member 120 upwardly until his (or her) arms are fully extended. The bench press member is then lowered and the exercise is repeated. The resistance to movement of the exercise bar 34 as the bench press member 120 is pushed upwardly can be adjusted whereby the force required to be exerted to overcome the resistance can be increased or decreased, depending on the strength of the user. The user can adjust the resistance without getting up from the bench.

The standard bench press exercise works the chest, shoulders, arms back, abdominals, hips, legs and buttocks, particularly the arms and chest.

Figure 8:
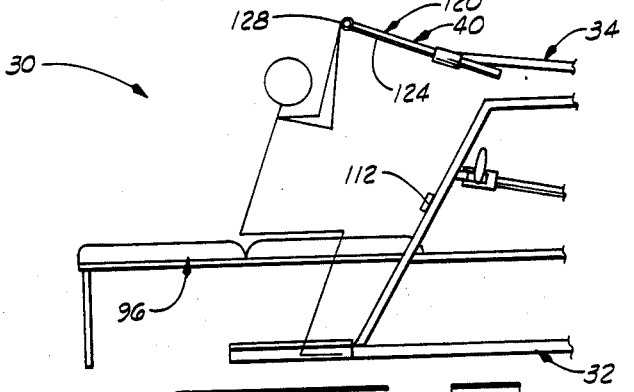

A forward chest press exercise that exercises the chest and biceps is shown in FIG. 8. The exercise is similar to the bench press exercise shown in FIG. 7, except the user sits on the bench facing the machine as the exercise is performed. For this type of exercise, the hand grip arms, 124 and 126, and hand grips, 128 and 130, are adjusted up relative to the frame 32. Other adjustments to the bench press member 120 can be made if desired.

Figure 9:
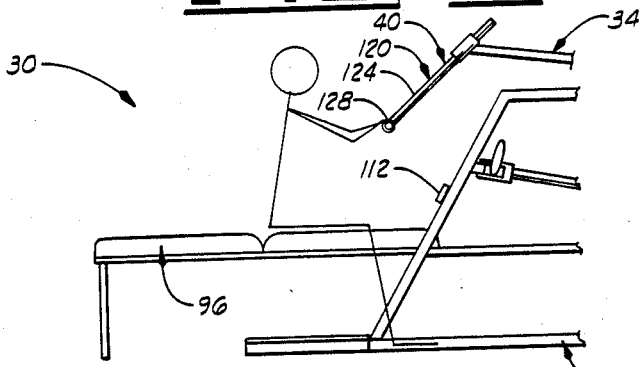

As shown in FIG. 9, the hand grip arms, 124 and 126, and hand grips, 128 and 130, can be adjusted down relative to the frame 32, and the hand grips may be moved to extend toward each other. With these adjustments, horizontal arm curls may be performed. As the user sits on the bench facing the machine, he (or she) grasps the first and second hand grips 128 and 130 and pulls the bench press member 120 upwardly toward his (or her) chest. This exercises the shoulders and arms, particularly the forearms.

Figure 10:
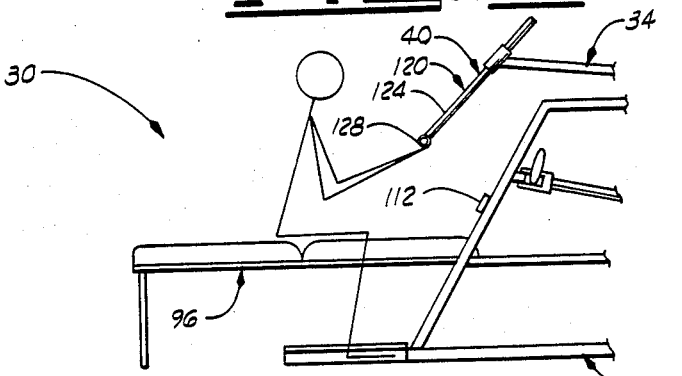

With the first and second hand grips 128 and 130 adjusted to extend outwardly from each other and down relative to the frame 32, vertical arm curls may be performed. This type of exercise is illustrated in FIG. 10. As with horizontal arm curls, the user sits on the bench facing the machine. The hand grips, however, are grasped with the hands positioned under the grips instead of over the grips. The bench press member 120 is again pulled upwardly toward the chest to work the upper shoulder, pectoral and bicep muscles.

Figure 11:
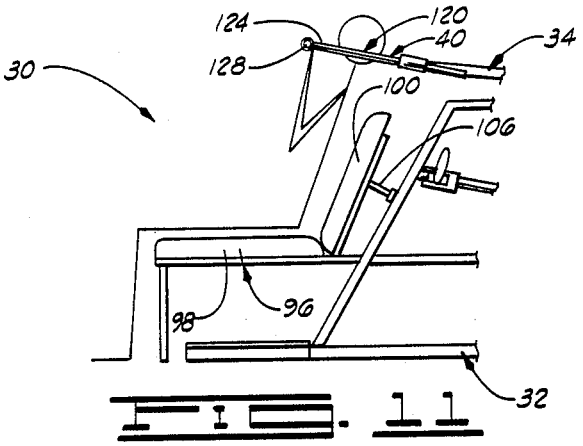

In FIG. 11, a reverse chest press exercise is illustrated. The second portion 100 of the bench 96 is inclined upwardly relative to the first portion 98 of the bench in order to transform the bench into a seat. The brace 106 is positioned to maintain the bench in the upright position. The hand grip arms, 124 and 126, and hand grips, 128 and 130, are adjusted up relative to the frame 32. The hand grips are adjusted to extend away from each other. As the user sits in the seat with his back toward the machine, the bench press member 120 is pushed upwardly. This type of exercise exercises the upper back and bicep muscles.

Figure 12:
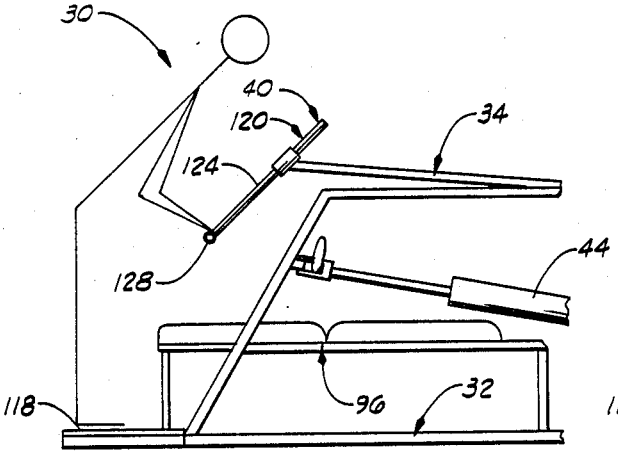
FIG. 12 is a partial side elevational view schematically illustrating one of the exercises that may be performed using the bench press member without the bench of the apparatus.

A standing arm curl exercise is illustrated in FIG. 12. The bench 96 is moved toward the frame 32 so that it is positioned out of the way of the user. The first and second hand grip arms, 124 and 126, and hand grips, 128 and 130, are adjusted down relative to the frame 32. The hand grips are adjusted to extend toward each other. With the bench 96 moved in toward the frame 32, the ground pad 118 is exposed. As the user stands on the ground pad 118 and faces the machine, he (or she) grasps the hand grips, 128 and 130, and pulls the bench press member 120 upwardly toward his (or her) chest. This type of exercise exercises the back and arm muscles.

Figure 13:
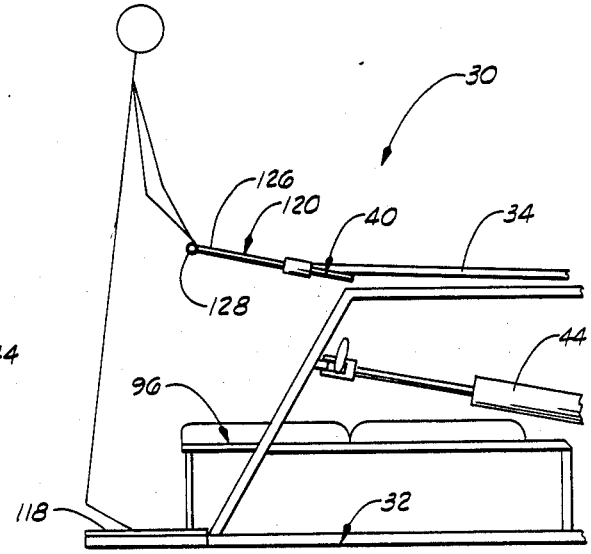
FIG. 13 is a partial side elevational view schematically illustrating another exercise that may be performed using only the bench press member of the apparatus.

The exercising apparatus 30 can also be used to exercise the various muscles in the legs and lower body. As illustrated in FIG. 13, various squat exercises can be performed. The bench 96 is moved toward the frame 32 so that it is positioned out of the way of the user. The hand grips 128 and 130 are adjusted to extend in opposite directions away from each other. The hand grip arms, 124 and 126, and hand grips 128 and 130 are adjusted either up or down relative to the frame 32 depending upon the height and arm length of the user. The hand grips are adjusted to the desired position toward or away from the handle bar 122. As the user stands on the ground pad 118 and faces the machine, he (or she) grasps the hand grips 128 and 130 with his (or her) hands positioned over the grips. With his (or her) arms fully extended, the user then raises the bench press member 120 as he (or she) stands up from a squat position or stands on his (or her) toes.

Figure 14:
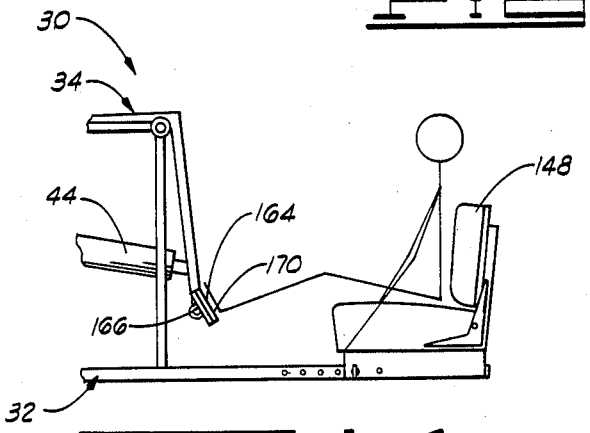
FIG. 14 is a partial side elevational view schematically illustrating one of the exercises that may be performed using the seat and leg press member of the apparatus.

The conventional leg press exercise is illustrated in Figure 14. The seat 148 is adjusted toward or away from the frame 32 depending upon the length of the legs of the user. the foot pads 170 and 172 are rotated relative to the exercise bar 34 to comfortably fit the feet of the user. The user sits in the seat 148 with his (or her) knees bent and his (or her) feet on the foot pads. The user then straightens his (or her) legs to push the leg press member 164 inwardly. This type of exercise exercises many of the lower body muscles. With the pads 170 and 172 positioned to support the middle of the feet of the user, the quadriceps are exercised. With the pads positioned to support the balls of the feet of the user, both the calves and quadriceps are exercised.

Thus, the apparatus 30 can be utilized to perform a wide variety of exercises. The exercises illustrated by the drawings and described above are only an example of the many exercises than can be performed. In addition, the user can stand on the ground pad 112 with his back toward the machine. By grasping the top of the hand grips and pulling upwardly, the user can exercise the neck, triceps and upper back muscles. The bench press member 120 can be used to simulate parallel bar exercises for body presses as well. Body press exercises work pectoral and tricep muscles. Chinups and pullups can also be performed on the apparatus. The bench 96 is completely removed from the apparatus 30. The user sits on the floor with his (or her) back to the machine, grasps the hand grips, and pulls his (or her) whole body up. Many other exercises can also be performed.

THE HYDRAULIC RAM

Although any type of hydraulic ram means for providing resistance to movement of the exercise bar 34 relative to the frame 32 may be disposed between the exercise bar and the frame, a hydraulic ram such as the hydraulic ram illustrated in FIGS. 15 through 19 is preferred.

Referring now specifically to FIGS. 15–19, a preferred embodiment of the hydraulic ram 44 is illustrated. The ram 44 includes a ram housing 188 for containing hydraulic fluid. The ram housing 188 has a first end 190 and a second end 192. Preferably, the housing is cylindrical in shape.

A ram plunger 194 is slidably disposed within the ram housing 188. The ram plunger has a first side 200 and a second side 202 opposite the first side. The sides 200 and 202 of the plunger 194 form first and second hydraulic fluid chambers 204 and 206, respectively, within the ram housing 188. The first and second hydraulic fluid chambers 204 and 206 are formed adjacent the first and second ends 190 and 192, respectively, of the ram housing 188. The plunger 194 is also preferably cylindrical in shape. In order to provide a seal between the chambers 204 and 206, the peripheral edge 205 of the plunger 194 fits snugly within the interior surface 207 of the housing 188.

As shown in FIG. 19, the ram plunger 194 includes a plurality of hydraulic fluid flow passages 208 disposed therein. The passages 208 communicate the first and second hydraulic fluid chambers 204 and 206 with each other.

Check valve means 210 are attached to the ram plunger 194 for allowing hydraulic fluid to freely flow from the first chamber 204 to the second chamber 206 through one or more of the passages 208, but preventing hydraulic fluid from flowing from the second chamber 206 to the first chamber 204.

A hollow ram shaft 212 sealingly extends through an opening 214 in the first end 190 of the ram housing 188. The shaft 212 has a first end 216 and a second end 218. The second end 218 of the shaft 212 is preferably attached to the frame 32, and the second end 192 of the ram housing 188 is preferably attached to the exercise bar 34. As will understood by those skilled in the art, the second end 192 of the ram housing 188 may be attached to the frame 32 and the second end 218 of the ram shaft 212 may be attached to the exercise bar 34. The first end 216 of the ram shaft 212 is attached to the ram plunger 194 and extends therethrough. Movement of the exercise bar 34 causes relative movement between the ram housing 188 and the ram plunger 194.

The hollow ram shaft 212 has an enlarged internal portion 220 adjacent the first end 216 thereof. The enlarged internal portion 220 includes a first hydraulic fluid port 222 extending from the interior 224 to the exterior 226 thereof. The first port 222 is positioned adjacent the ram plunger 194 on the side thereof forming the first hydraulic fluid chamber 204. By this arrangement, hydraulic fluid can flow from the second hydraulic fluid chamber 206 to the first hydraulic fluid chamber 204 by way of the first end 216 of the hollow ram shaft 212, the enlarged internal portion 220 of the hollow ram shaft and the first port 222 disposed therein.

The hydraulic ram 44 further includes an adjustable valve 228 for controlling the rate of flow of hydraulic fluid from the second hydraulic fluid chamber 206 to the first hydraulic fluid chamber 204 by way of the first end 216 of the hollow ram shaft 212, the enlarged internal portion 220 of the hollow ram shaft 212 and the first port 222 disposed therein. By controlling the rate of flow of fluid from the second chamber 206 to the first chamber 204, the adjustable valve 228 controls the resistance to movement of the exercise bar 34 relative to the frame 32 in the one direction.

The adjustable valve 228 includes a cylinder 230 sealingly and rotatably disposed within the enlarged internal portion 220 of the shaft 212. The cylinder 230 is disposed in the enlarged internal portion 220 adjacent the first hydraulic fluid port 222 thereof. The end 232 of the cylinder 230 facing the second end 218 of the hollow ram shaft 212 is closed. The end 234 of the cylinder 230 facing the second end 192 of the ram housing 188 is open. The end 234 opens up to the second hydraulic fluid chamber 206 formed in the ram housing 188. Alternatively, the end 234 of the cylinder 230 can be closed and one or more openings can be disposed in the cylinder for allowing fluid to flow from the second chamber 260 therein.

The cylinder 230 includes a second hydraulic fluid port 236 disposed through a side 238 thereof. The second port 236 is positioned whereby it and the first port 222 of the enlarged internal portion 220 of the shaft 212 can be moved into and out of alignment with each other by rotating the cylinder 230. Moving the ports 222 and 236 into and out of alignment with each other increases and decreases, respectively, the rate of flow of hydraulic fluid from the second chamber 206 to the first chamber 204. When the first port 222 and the second port 236 are aligned, a continuous passage from the second chamber 206 to the first chamber 204 is created. The fluid flows from the second chamber 206 to the first chamber 204 by way of the first end 216 of the shaft 212, the enlarged internal portion 220 of the shaft, the cylinder 230 and the second port 236 thereof, and the first port 222 of the enlarged internal portion. Depending on the size of the cylinder 230, the fluid may flow directly from the second chamber 206 to the cylinder. As the ports are moved into alignment, the continuous passage created thereby increases in size, and the rate of flow increases. Conversely, as the ports are moved out of alignment, the continuous passage decreases in size, and the rate of flow decreases.

Figure 16:
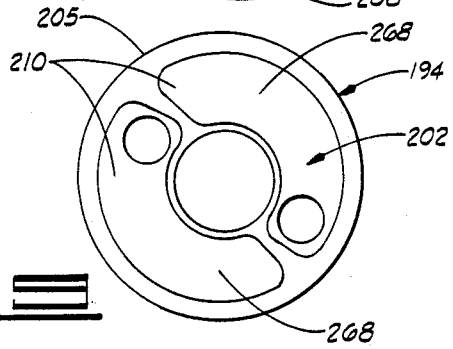
FIG. 16 is a side elevational view of the adjustable valve of the hydraulic ram having the elongated shaft member attached thereto.
Figure 15:
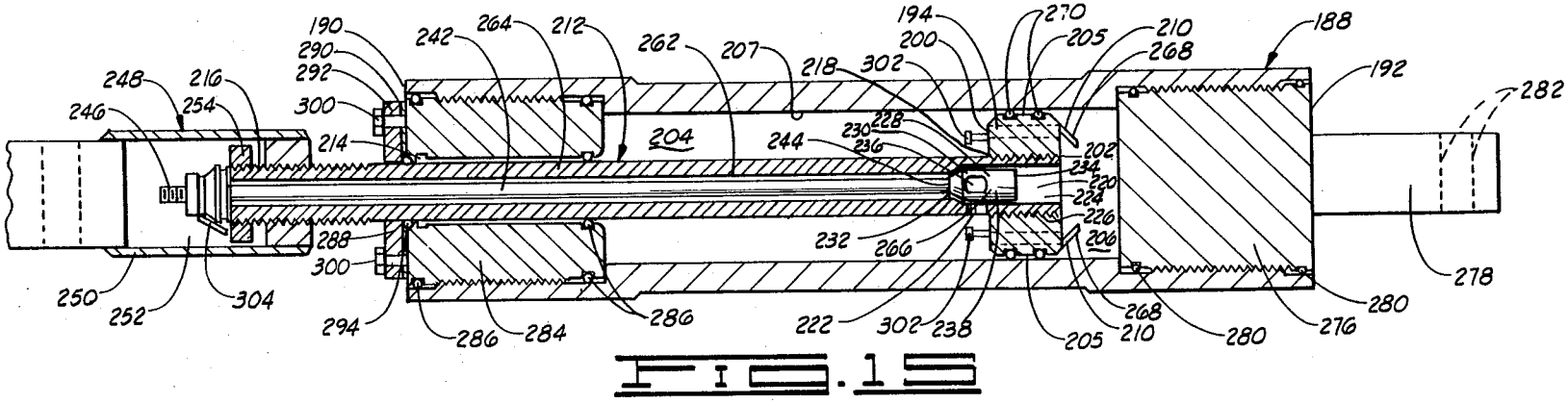

Means are provided for manually rotating the cylinder 230 from outside the ram housing 188 to move the first port 222 and the second port 236 into and out of alignment with each other. Those means include an elongated shaft member 242 sealingly disposed within the hollow ram shaft 212. The elongated shaft member 242 has a first end 244 and a second end 246. The first end 244 of the elongated shaft member 242 is attached to the closed end 232 of the cylinder 230. The second end 246 of the elongated shaft member 242 extends through the second end 218 of the hollow ram shaft 212. Means for manually rotating the elongated shaft member 242 in order to rotate the cylinder 230 from outside the housing 188 are attached to the second end 246 of the shaft member. In FIG. 16, the elongated shaft member 242 having the first end 244 thereof attached to the closed end 232 of the cylinder 230 is illustrated.

A shaft extension arm 248 is disposed between the second end 218 of the hollow ram shaft 212 and preferably the frame 32. As will be understood by those skilled in the art, if the second end 218 of the hollow ram shaft 212 is attached to the exercise bar 34, then the shaft extension arm 248 will be disposed between the second end of the shaft and the exercise bar. The shaft extension arm 248 has a surface 250 having an opening 252 therein. The opening 252 allows access to the second end 246 of the elongated shaft member 242 from outside the ram housing 188.

The means for manually rotating the elongated shaft member 242 include a handle 254, a handle having a first end 256 and a second end 258 (see FIG. 1). The first end 256 of the handle 254 is attached to the second end 246 of the elongated shaft member 242. The second end 258 of the handle 254 extends through the opening 252 in the surface 250 of the shaft extension arm 248. Thus, the handle 254 can be turned from outside the ram housing 188 to rotate the elongated shaft member 242. By rotating the elongated shaft member 242, the cylinder 230 is rotated to move the first port 222 of the enlarged internal portion 220 of the shaft 212 and the second port 236 of the cylinder into and out of alignment with each other. This arrangement provides a simple way to adjust the resistance to the movement of the exercise bar 34 whereby the force required to be exerted on the bar by way of the bench press member 120, or the leg press member 164 to overcome the resistance can be selectively changed.

The resistance can be adjusted quickly and easily, often while the apparatus is in operation. The adjustable valve 228 allows the resistance to be adjusted to an infinite number of settings. The first hydraulic fluid port 222 and the second hydraulic fluid port 236 can be moved completely out of alignment with each other to completely close the continuous passage created thereby and totally prevent the flow of hydraulic fluid from the second hydraulic fluid chamber 206 to the first hydraulic fluid chamber 204. This prevents the exercise bar 34 from being moved in the one direction. As the first port 222 and the second port 236 are aligned, hydraulic fluid is allowed to flow from the second chamber 206 to the first chamber 204. As the continuous passage created by the ports increases in size, the rate of flow of hydraulic fluid from the second chamber 206 to the first chamber 204 increases, and the resistance to the movement of the exercise bar 34 relative to the frame 32 decreases.

The interior surface 224 of the enlarged internal portion 220 of the hollow ram shaft 212 is cylindrical in shape, and is larger in area than the interior 262 of the remainder 264 of the shaft. The interior surface 224 of the enlarged internal portion 220 is slightly larger in diameter than the exterior surface 266 of the cylinder 230 whereby the cylinder 230 fits snugly within the enlarged internal portion 220.

As shown in FIG. 19, the check valve means 210 include one or more flexible closure members 268 pivotally attached to the ram plunger 194 over one or more of the passages 208 of the plunger. The closures members 268 are attached to the plunger 194 on the second side 202 thereof, the side that forms the second hydraulic fluid chamber 206. Hydraulic fluid flows from the first chamber 204 into the passages 208. When the fluid reaches the second side 202 of the plunger 194, it forces the flexible closure members 268 to bend away from the passages 208 so that it can flow into the second chamber 206. When the fluid stops flowing into the second chamber 206, the closure members 268 naturally bend back and cover the passages 208. As the fluid flows back toward the first chamber 204, the flexible closure members remain over the passages 208 to force the fluid through the adjustable valve 228.

One or more O-rings 270 are disposed between the ram plunger 194 and the interior surface 207 of the ram housing 188. Preferably, a pair of O-rings are utilized. The double O-rings system provides stability to the plunger as the plunger slides relative to the housing and provides a tight seal between the first chamber 204 and the second chamber 206.

The second end 192 of the ram housing 188 includes a first ram support member 276. A first ram connection unit 278 extends outwardly from the first ram support member 276 and is utilized to connect the ram 44 to either the frame 32 or the exercise bar 34. One or more O-rings 280 seal the first ram support member 276 from the second hydraulic fluid chamber 206. The first ram connection unit 278 includes one or more holes 282 that are aligned with corresponding holes (not shown) in either the frame 32 or the exercise bar 34. One or more bolts or other suitable connecting means are inserted through the holes to lock the second end 192 of the ram housing 188 to frame 32 or the exercise bar 34.

The first end 192 of the ram housing 188 includes a second ram support member 284. One or more O-rings 286 are disposed between the second ram support member 284 and the interior surface 207 of the ram housing 188 to seal the first hydraulic fluid chamber 204 from the second ram support member.

A shaft wiper 288 is attached to the first end 190 of the ram housing 188. The wiper 288 serves to absorb any hydraulic fluid or other material that accumulates on the hollow ram shaft 212 as the shaft moves in and out of the ram housing 188. The wiper 288 includes a felt pad 290 and a plate 292. The plate 292 is attached to first end 290 of the housing 188 with the felt pad 290 disposed therebetween. One or more O-rings 294 are disposed between the wiper 288 and the first end 190 of the ram housing 188 adjacent the hollow ram shaft 212 to seal the opening 214 in the first end of the housing. Other O-rings and various seals may be utilized to seal the opening 214. A pair of bolts 300 hold the wiper 288 to the first end 190 of the housing 188.

A pair travel stops 302 are attached to the first side 200 of the ram plunger 194. The travel stops 302 abut the second ram support member 284 when the ram 44 is completely extended. They serve to protect the ram plunger 194 from structural damage.

A resistance adjustment pointer 304 is attached to the elongated shaft member 242 adjacent the handle 254 for indicating to the user how the resistance to movement of the exercise bar 34 is set. Various gauges or other means may also be utilized to indicate how the resistance is set.

OPERATION OF THE HYDRAULIC RAM

Figure 15:
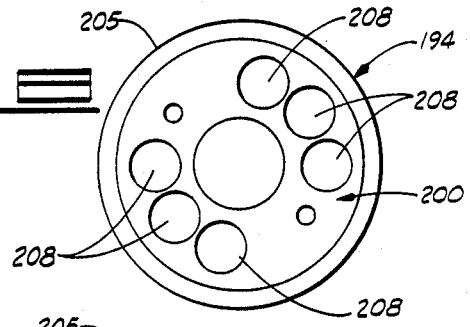
FIG. 15 is a side sectional view of the hydraulic ram of the present invention with the ram in a first position.
Figure 17:
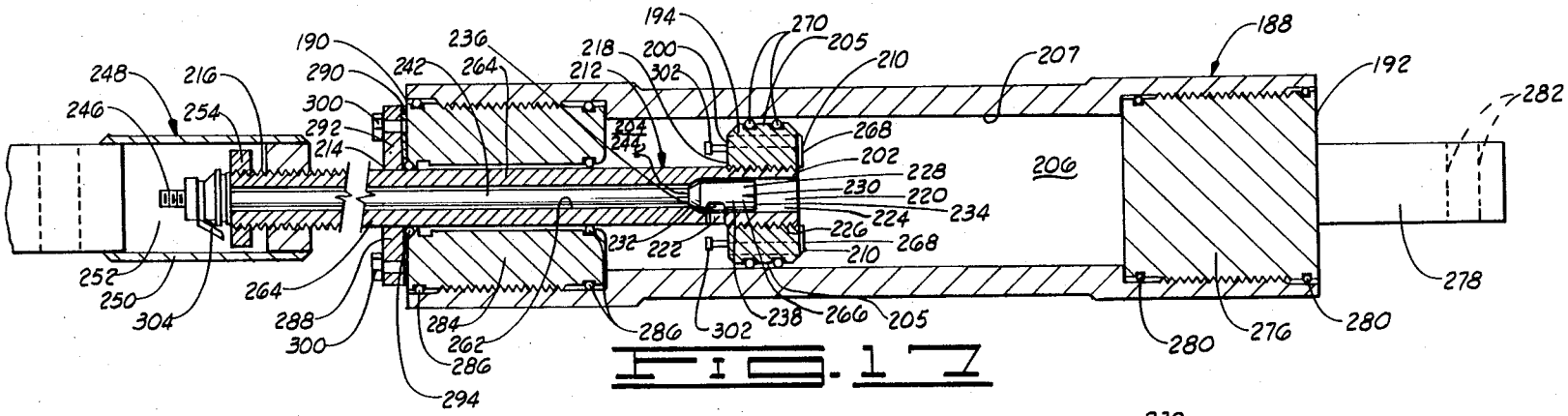
FIG. 17 is a side elevational view of the hydraulic ram of the present invention with the ram in a second position.
Figure 16:
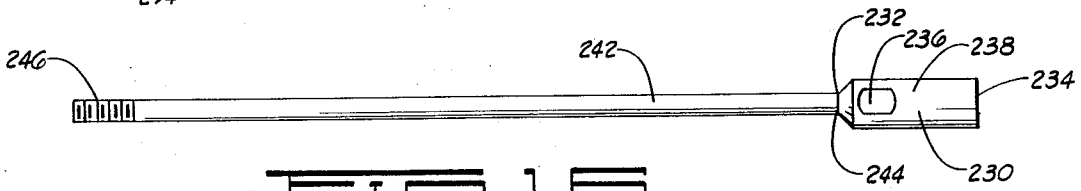

Referring now to FIGS. 1, 15 and 17, the operation of the hydraulic ram 44 will be described.

As previously described, the second end 218 of the shaft 212 can be attached to the exercise bar 34, and the second end 194 of the ram housing 188, particularly the first ram connection unit 278 of the first ram support member 276, can be attached to the frame 32. As will be understood by those skilled in the art, the first ram connection unit 278 may be attached to the exercise bar 34, and the second end 218 of the shaft 212 may be attached to the frame 32. For purposes of this discussion, it is assumed that the first ram connection unit 278 is attached to the exercise bar 34 and the second end 218 of the shaft 212 is attached to the frame 32.

Unless the exercise bar 34 is moved relative to the frame 32, the ram 44 remains substantially in the position shown in Figure 17. The ram plunger 194 is closest to the first end 190 of the ram housing 188. Most of the hydraulic fluid is in the second hydraulic fluid chamber 206. Most of the hollow ram shaft 212 extends outside the housing 188.

Before exercising, the user of the apparatus 30 turns the handle 254 to adjust the resistance to movement of the exercise bar 34 to the desired setting. When the ports 222 and 236 are aligned such that the continuous passage created thereby is as large as possible, the rate of flow of hydraulic fluid from the second chamber 206 to the first chamber 204 will be as high as possible and the resistance to movement of the exercise bar will be at the lowest setting.

In FIG. 15, the ports 222 and 236 are shown to be moved out of alignment such that a continuous passage from the second chamber 206 to the first chamber 204 does not exist. As shown in FIG. 17, the cylinder 230 can be rotated to move the fluid port 222 and the port 236 into alignment to create the continuous passage from the second chamber 206 to the first chamber 204. As a result, hydraulic fluid can flow from the second chamber 206 to the first chamber 204 and the resistance to the movement of the exercise bar 34 relative to the frame 32 is decreased.

With the resistance adjusted to the desired setting, the operator exercises by utilizing the bench press member 120 or the leg press member 164 to move the exercise bar 34 relative to the frame 32. As the exercise bar 34 is moved relative to the frame 32, the ram plunger 194 moves from adjacent the first end 190 of the ram housing 188 toward the second end 192 of the ram housing, and the hydraulic fluid flows from the second chamber 206 to the first chamber 204. As shown in FIG. 17, as the plunger 194 moves toward the second end 192 of the housing 188, the flow of the fluid forces the closure members 268 to seal the passages 208 closed. This forces the hydraulic fluid to flow from the second chamber 206 to the first chamber 204 by way of the adjustable valve 228. The fluid flow by way of the first end 216 of the hollow ram shaft 212, the enlarged internal portion 220 of the shaft, the cylinder 230 and the second port 236 thereof, and the first port 222 of the enlarged internal portion.

When the exercise bar 34 is fully extended, the ram 44 is fully compressed. This position is shown in FIG. 15. The ram plunger 194 is positioned adjacent the second end 192 of the ram housing 188. Most of the hydraulic fluid is in the first hydraulic fluid chamber 204. Most of the hollow ram shaft 212 extends within the ram housing 188. As the exercise bar is lowered or released, the ram plunger 194 begins to move from adjacent the second end 192 of the ram housing 188 towards the first end 190 thereof. The hydraulic fluid flows from the first chamber 204 to the second chamber 206 by way of the passages 208 in the plunger. As the fluid flows through the passages in this direction, it forces the closure members 268 open so that it can flow into the second chamber 206. Thus, as the plunger moves from adjacent the second end 192 of the ram housing toward the first end 200 thereof, the hydraulic fluid is bypassed around the adjustable valve 228 and allowed to freely flow from the first chamber 204 to the second chamber 206. The bench press member 120 is lowered and the leg press member 164 is released with substantially no resistance. This permits "rapid thrust" type exercises to be performed.

The simple construction of the ram 44 permits the resistance to be adjusted to an infinite number of settings. The resistance can be adjusted accurately and quickly with little effort by the operator. There are no complex conduit systems involved. The ram is sturdy and requires little maintenance.

The apparatus of this invention is well adapted, therefore, to carry out the objects and attain the ends and advantages mentioned as well as those inherent therein. While numerous changes in the construction and arrangement of the parts will suggest themselves to those skilled in the art, such changes are encompassed within the spirit of this invention as defined in the appended claims.

What is claimed is:

1. An exercising apparatus, comprising:

a frame;

an exercise bar having a first end and a second end, said exercise bar being pivotally attached between said first and second ends to said frame;

a first exercise station comprising:

first exercising means attached to said first end of said exercise bar for allowing the user of said apparatus to move said exercise bar relative to said frame; and first user support means positioned adjacent said first exercising means for supporting said user while said user operates said first exercising means to move said exercise bar;

a second exercise station comprising:

second exercising means attached to said second end of said exercise bar for allowing said user to move said exercise bar relative to said frame; and second user support means positioned adjacent said second exercising means for supporting said user while said user operates said second exercising means to move said exercise bar; and a hydraulic ram disposed between said exercise bar and said frame for providing resistance to movement of said exercise bar relative to said frame in one direction, but providing substantially no resistance to movement of said exercise bar relative to said frame in the other direction.

2. The apparatus of claim 1, wherein said hydraulic ram is further characterized to include means for adjusting said resistance to movement of said exercise bar whereby the force required to be exerted on said bar by way of said first and second exercising means to overcome said resistance can be selectively changed.

3. The apparatus of claim 1 wherein said first user support means comprises a bench.

4. The apparatus of claim 3, wherein said bench comprises a first portion and a second portion, said second portion being inclinable upwardly relative to said first portion in order to transform said bench into a seat.

5. The apparatus of claim 3, wherein said bench is slidably attached to said frame and may be moved toward or away from said frame.

6. The apparatus of claim 1, wherein said first exercising means comprises a bench press member for supporting the hands of said user.

7. The apparatus of claim 6, wherein said bench press member comprises:

a handle bar rotatably attached to said first end of said exercise bar;

first and second hand grip arms slidably and rotatably attached to said handle bar; and first and second hand grips attached to said first and second hand grip arms, respectively, and extending perpendicularly therefrom, whereby said handle bar may be rotated relative to said exercise bar to move said first and second hand grip arms and said first and second hand grips up or down relative to said frame, and each of said first and second hand grip arms may be moved perpendicularly relative to said handle bar to move said corresponding first and second hand grips toward or away from said handle bar and may be rotated relative to said handle bar to move said corresponding first and second hand grips toward or away from each other.

8. The apparatus of claim 1 wherein said second user support means comprises a seat.

9. The apparatus of claim 8, wherein said seat is slidably attached to said frame and may be moved toward or away from said frame.

10. The apparatus of claim 1, wherein said second exercising means comprises a leg press member for supporting the feet of said user.

11. The apparatus of claim 10, wherein said leg press member comprises:

first and second foot pad arms attached to and extending in opposite directions from said second end of said exercise bar; and first and second foot pads rotatably attached to said first and second foot pad arms, respectively, whereby each of said first and second foot pads may be rotated relative to said exercise bar.

12. An exercising apparatus, comprising:

a frame;

an exercise bar pivotally attached to said frame;

exercising means attached to said exercise bar for allowing the user of said apparatus to move said exercise bar relative to said frame; and a hydraulic ram disposed between said exercise bar and said frame for providing resistance to movement of said exercise bar relative to said frame in one direction, but providing substantially no resistance to movement of said exercise bar relative to said frame in the other direction, said hydraulic ram comprising:

a ram housing for containing hydraulic fluid, said housing having a first end and a second end, said first end having an opening disposed therein;

a ram plunger slidably disposed within said ram housing, the opposite sides of said plunger forming first and second hydraulic fluid chambers within said housing adjacent said first and second ends of said housing, respectively, said plunger including a plurality of hydraulic fluid flow passages therein communicating said first and second chambers, said passages being of a size sufficient to allow hydraulic fluid to flow from said first chamber to said second chamber with substantially no resistance when said exercise bar is moved relative to said frame in said other direction;

check valve means attached to said plunger for allowing hydraulic fluid to flow through said passages in said plunger from said first chamber to said second chamber with substantially no resistance, but preventing hydraulic fluid from flowing from said second chamber to said first chamber when said exercise bar is moved relative to said frame in said one direction;

a hollow ram shaft sealingly extending through said opening in said first end of said housing, said shaft having first and second ends, one of said second end of said housing and said second end of said shaft being attached to said frame, the other of said second end of said housing and said second end of said shaft being attached to said exercise bar, and said first end of said shaft being attached to said plunger and extending therethrough, wherein movement of said exercise bar causes relative movement between said ram housing and said ram plunger, said shaft having an enlarged internal portion adjacent said first end thereof, said enlarged internal portion including a first hydraulic fluid port extending from the interior to the exterior thereof and positioned adjacent said plunger on the side thereof forming said first chamber, whereby hydraulic fluid can flow from said second chamber to said first chamber by way of said first end of said hollow ram shaft, said enlarged internal portion of said hollow ram shaft and said first port therein;

an adjustable valve for controlling the rate of flow of hydraulic fluid from said second chamber to said first chamber and thereby controlling the resistance to movement of said exercise bar relative to said frame in said one direction, said adjustable valve comprising:

a cylinder sealingly and rotatably disposed within said enlarged internal portion of said hollow ram shaft adjacent said first port thereof, the end of said cylinder facing said second end of said shaft being closed and said cylinder including a second hydraulic fluid port disposed through a side thereof and positioned whereby said first port of said enlarged internal portion of said ram shaft and said second port of said cylinder can be moved into and out of alignment with each other by rotating said cylinder; and means for manually rotating said cylinder from outside said ram housing to move said first port of said enlarged internal portion of said ram shaft and said second port of said cylinder into and out of alignment with each other.

13. The apparatus of claim 12, wherein said means for manually rotating said cylinder from outside said ram housing comprises:

an elongated shaft member sealingly disposed within said hollow ram shaft, said shaft member having first and second ends, the first end being attached to the closed end of said cylinder and the second end extending through said second end of said hollow ram shaft; and means for manually rotating said shaft member attached to said second end thereof.

14. The apparatus of claim 13, further comprising a shaft extension arm disposed between said second end of said shaft and one of said exercise bar and said frame, the other of said exercise bar and said frame being attached to said second end of said housing, said shaft extension arm having a surface having an opening therein.

15. The apparatus of claim 14, wherein said means for manually rotating said shaft member comprises a handle having a first end and a second end, said first end of said handle being attached to said second end of said elongated shaft member and said second end of said handle extending through said opening in said surface of said shaft extension arm.

16. The apparatus of claim 12, wherein the interior surface of said enlarged internal portion of said hollow ram shaft is cylindrical in shape and is larger in area than the interior surface of the remainder of said shaft.

17. The apparatus of claim 16, wherein said interior surface of said enlarged internal portion of said hollow ram shaft is slightly larger than the exterior surface of said cylinder of said adjustable valve, and said cylinder fits snugly within said enlarged internal portion of said hollow ram shaft.

18. The apparatus of claim 12, wherein said check valve means are comprised of a plurality of closure members pivotally attached to said plunger over said passages on the side of said plunger forming said second hydraulic fluid chamber.

19. An exercising apparatus comprising:

a frame;

an exercise bar having a first end and a second end, said exercise bar being pivotally attached between said first and second ends to said frame;

a first exercise station comprising:

first exercising means attached to said first end of said exercise bar for allowing the user of said apparatus to move said exercise bar relative to said frame; and first user support means positioned adjacent said first exercising means for supporting said user while said user operates said first exercising means to move said exercise bar;

a second exercise station comprising:

second exercising means attached to said second end of said exercise bar for allowing said user to move said exercise bar relative to said frame; and second user support means positioned adjacent said second exercising means for supporting said user while said user operates said second exercising means to move said exercise bar; and a hydraulic ram disposed between said exercise bar and said frame for providing resistance to movement of said exercise bar relative to said frame in one direction, but providing substantially no resistance to movement of said exercise bar relative to said frame in the other direction, said resistance to movement of said exercise bar in said one direction being adjustable whereby the force required to be exerted on said exercise bar by way of said first and second exercise means to overcome said resistance can be selectively changed, said hydraulic ram comprising:

a ram housing for containing hydraulic fluid, said housing having a first end and a second end, said first end having an opening disposed therein; a ram plunger slidably disposed within said ram housing, the opposite sides of said plunger forming first and second hydraulic fluid chambers within said housing adjacent said first and second ends of said housing, respectively, said plunger including a plurality of hydraulic fluid flow passages therein communicating said first and second chambers, said passages being of a size sufficient to allow hydraulic fluid to flow from said first chamber to said second chamber with substantially no resistance when said exercise bar is moved relative to said frame in said other direction;

check valve means attached to said plunger for allowing hydraulic fluid to flow through said passages in said plunger from said first chamber to said second chamber with substantially no resistance, but preventing hydraulic fluid from flowing from said second chamber to said first chamber when said exercise bar is moved relative to said frame in said one direction;

a hollow ram shaft sealingly extending through said opening in said first end of said ram housing, said shaft having first and second ends, one of said second end of said housing and said second end of said shaft being attached to said frame, the other of said second end of said housing and said second end of said shaft being attached to said exercise bar, and said first end of said shaft being attached to said plunger and extending therethrough, whereby movement of said exercise bar causes relative movement between said ram housing and said ram plunger, said hollow ram shaft having an enlarged internal portion adjacent said first end thereof, said enlarged internal portion including a first hydraulic fluid port extending from the interior of the exterior thereof positioned adjacent said plunger on the side thereof forming said first chamber, whereby hydraulic fluid can flow from said second chamber to said first chamber by way of said first end of said hollow ram shaft, said enlarged internal portion of said shaft and said first port therein;

an adjustable valve for controlling the rate of flow of hydraulic fluid from said second chamber to said first chamber and thereby controlling the resistance to movement of said exercise bar relative to said frame in said one direction, said adjustable valve comprising:

a cylinder sealingly and rotatably disposed within said enlarged internal portion of said hollow ram shaft adjacent said first port thereof, the end of said cylinder facing said second end of said shaft being closed and said cylinder including a second hydraulic fluid port disposed through a side thereof and positioned whereby said first port of said enlarged internal portion of said ram shaft and said second port of said cylinder can be moved into and out of alignment with each other by rotating said cylinder; and means for manually rotating said cylinder from outside said ram housing to move said first port of said enlarged internal portion of said ram shaft and said second port of said cylinder into and out of alignment with each other.

20. The apparatus of claim 19, wherein said means for rotating said cylinder from outside said ram housing comprises:

an elongated shaft member sealingly disposed within said hollow ram shaft, said shaft member having first and second ends, the first end being attached to said closed end of said cylinder and the second end extending through said second end of said hollow ram shaft; and means for manually rotating said shaft member attached to said second end thereof.

21. The apparatus of claim 20, further comprising a shaft extension arm disposed between said second end of said shaft and one of said frame and said exercise bar, the other of said frame and said exercise bar being attached to said second end of said housing, said shaft extension arm having a surface having an opening therein.

22. The apparatus of claim 21, wherein said means for manually rotating said shaft member comprises a handle having a first end of second end, said first end of said handle being attached to said second end of said elongated shaft member and said second end of said handle extending through said opening in said surface of said shaft extension arm.

23. The apparatus of claim 19, wherein the interior surface of said enlarged internal portion of said hollow ram shaft is cylindrical in shape and is larger in area than the interior surface of the remainder of said shaft.

24. The apparatus of claim 23, wherein said interior surface of said enlarged internal portion of said shaft is slightly larger than the exterior surface of said cylinder of said adjustable valve, and said cylinder fits snugly within said enlarged internal portion of said shaft.

25. The apparatus of claim 19, wherein said check valve means are comprised of a plurality of closure members pivotally attached to said plunger over said passages on the side of said plunger forming said second hydraulic fluid chamber.

26. The apparatus of claim 19 wherein said first user support means comprises a bench and said second user support means comprises a seat.

27. The apparatus of claim 19, wherein said first exercising means comprises a bench press member for supporting the hands of said user, said bench press member comprising:

a handle bar rotatably attached to said first end of said exercise bar;

first and second hand grip arms slidably and rotatably attached to said handle bar;

first and second hand grips attached to said first and second hand grip arms, respectively, and extending perpendiculary therefrom, whereby said handle bar may be rotated relative to said exercise bar to move said first and second hand grip arms and said first and second hand grips up or down relative to said frame, and each of said first and second hand grip arms may be moved perpendicularly relative to said handle bar to move said corresponding first and second hand grips toward or away from said handle bar and may be rotated relative to said handle bar to move said corresponding first and second hand grips toward or away from each other.

28. The apparatus of claim 19, wherein second exercising means comprises a leg press member for supporting the feet of said user, said leg press member comprising:

first and second foot pad arms attached to and extending in opposite directions from said second end of said exercise bar; and first and second foot pads rotatably attached to said first and second foot pad arms, respectively, whereby each of said first and second foot pads may be rotated relative to said exercise bar and said first and second foot pad arms.

* * * * *

UNITED STATES PATENT AND TRADEMARK OFFICE

CERTIFICATE OF CORRECTION

PATENT NO. : 4,786,051

DATED : November 22, 1988

INVENTOR(S) : Joe E. Mullican

It is certified that error appears in the above-identified patent and that said Letters Patent are hereby corrected as shown below:

Column 4, line 50, insert the word --includes-- between the numeral "30" and the word "a";

Column 4, line 52, delete the word "includes" (first occurrence);

Column 9, line 6, delete the word "the" and substitute the word --The-- therefor;

Column 14, line 5, delete the word "flow" and substitute the word --flows-- therefor; and Column 19, line 35, delete the word "of" (first occurrence) and substitute the words --and a-- therefor.

Signed and Sealed this

Fourteenth Day of March, 1989

*Attest:*

DONALD J. QUIGG

*Attesting Officer*

*Commissioner of Patents and Trademarks*